United States Patent [19]

Gestetner

[11] 4,165,193

[45] Aug. 21, 1979

[54] LOOSE-LEAF FOLDER

[75] Inventor: Alfred Gestetner, 2935 Brighton St., Montreal, Quebec, Canada

[73] Assignee: Alfred Gestetner, Canada

[21] Appl. No.: 812,426

[22] Filed: Jul. 1, 1977

[51] Int. Cl.[2] ..... B42F 13/12; B42F 13/36

[52] U.S. Cl. ..... 402/61; 281/31; 402/71

[58] Field of Search ..... 402/19, 22, 48, 60, 402/61, 62, 68, 71, 73, 74, 79, 80 R; 281/3 R, 29, 31, 35

[56] References Cited

U.S. PATENT DOCUMENTS

| | | | |
|---|---|---|---|
| 554,090 | 2/1896 | Reifschneider | 402/60 X |
| 847,364 | 3/1907 | Parry | 402/61 X |
| 971,007 | 9/1910 | Hubbard | 402/61 |
| 1,798,119 | 3/1931 | Garlock | 281/31 X |
| 1,900,601 | 3/1933 | Felder | 402/61 |

FOREIGN PATENT DOCUMENTS

| | | | |
|---|---|---|---|
| 524569 | 9/1921 | France | 402/61 |

*Primary Examiner*—Travis S. McGehee

*Attorney, Agent, or Firm*—Stevens, Davis, Miller & Mosher

[57] ABSTRACT

This specification discloses a folder suitable, for example, as a bank passbook for the retention or protection of sheets of paper or other like material comprising a pair of spaced post portions of snap fasteners near a fold line in the folder and attached to and projecting from one side of the folder and adapted to pass through holes in the sheets of paper, a pair of spaced cap portions of the snap fasteners adapted to cooperate with said post portions and removable to permit removal or insertion of sheets of paper from said folder, and a sheet of resilient, flexible plastic or like material affixed to and projecting from said folder at or about the fold line with one hole in register with each post portion and adapted to retain the sheets of paper loosely in position on the post portions when the cap portions are removed from the post portions.

6 Claims, 2 Drawing Figures

LOOSE-LEAF FOLDER

The present invention relates to a folder, more particularly, to a folder for the retention or protection of sheets of paper or like material. The folder of this invention is, for example, adaptable as a bank passbook.

Many banks have been extensively using a loose-leaf folder binding sheets of paper which record the deposits made by a customer into his account. These conventional bank passbooks exhibit difficulties to open and insert or remove the sheets which record the deposits made, without the sheets being displaced.

The inventor has found that a flexible plastic sheet will overcome the difficulties or inconvenience which accompany the use of the conventional passbooks, when a resilient, flexible plastic sheet is placed on the top sheet of paper retained in the folder. It is obvious that this idea may be useable not only for bank passbooks but also for various kinds of folders such as notebooks, catalogues, and the like.

The object of this invention is therefore to provide a loose-leaf folder which facilitates easy insertion or removal of sheets of paper from the folder.

Another object of the invention is to provide a loose-leaf folder which can be produced at a low cost and also be suitable for mass production.

According to one aspect of this invention, there is provided a folder for the retention or protection of sheets of paper or other like material, comprising at least one retaining post near a fold line in the folder and attached to and projecting inwardly from one side of the folder and adapted to pass through holes in the sheets of paper, a cap means adapted to cooperate with said retaining post and and removable to permit removal or insertion of sheets of paper from said folder, and a sheet of resilient, flexible plastic or like material affixed to and projecting from said folder at or about the fold line with one hole in register with each retaining post and adapted to retain the sheets of paper loosely in position on the retaining post when retaining cap means are removed from the retaining post.

According to another aspect of this invention, there is provided a folder for the retention or protection of sheets of paper or other like material, comprising a pair of spaced post portions of snap fasteners near a fold line in the folder and attached to and projecting from one side of the folder and adapted to pass through holes in the sheets of paper, a pair of spaced cap portions of the snap fasterners adapted to cooperate with said post portions and removable to permit removal or insertion of sheets of paper from said folder, and a sheet of resilient, flexible plastic or like material affixed to and projecting from said folder at or about the fold line with one hole in register with each post portion and adapted to retain sheets of paper loosely in position on the post portion when the cap portions are removed from the post portions.

According to further aspect of this invention, there is provided such folders as set out above where the folder is a bank passbook for the retention of bank customers' account records.

The invention, its objects and its various advantages will become more apparent to those skilled in the art from the ensuing detailed description of the preferred embodiment which follows, references being made to accompanying drawings wherein like numerals denote like parts.

Figure 1:
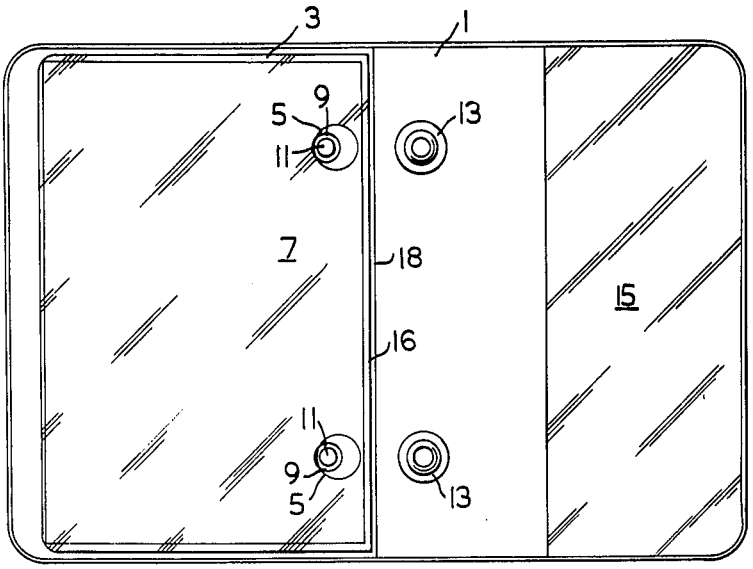
FIG. 1 shows a top plan view of one embodiment of a bank passbook, with the fasteners completely opened.
Figure 2:
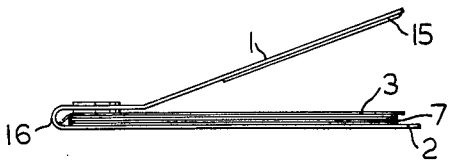
FIG. 2 illustrates a side-elevational view of the same bank passbook as in FIG. 1, with the fasteners completely closed and the front sheet of the folder opened.

Referring to the figures, the sheets of paper 7 bear a pair of spaced holes 9, 9 therethrough. Placed on the top sheet of paper, is a transparent, resilient, flexible plastic sheet 3 through which a pair of matching holes 5, 5 are provided. A transparent sheet is preferred to a translucent or opaque plastic sheet because the information on the top sheet of paper is readable through the transparent sheet without turning it. The transparent plastic sheet 3 is integral by attachment at line 16 to folder 1 near the fold line 18 thereof along the proximal side of the plastic sheet. The folder is preferably made of a single sheet of plastic. Through the holes 9, 9 of the sheets of paper and the matching holes 5, 5 of the plastic sheet, there are provided a pair of spaced post portions 11, 11 of snap fasteners, which posts are secured to the back sheet of the folder at the bottom ends thereof. A pair of spaced cap portions 13, 13 of the snap faasteners are provided and are attached to the front sheet of the folder.

In this embodiment a pocket 15 is provided on the inner surface of the front sheet of the folder. Another pocket may be provided on the inner surface of the back sheet of the folder. The pocket is made of flexible, resilient plastic sheet, preferably being transparent, and is heat-sealed to the folder along the peripheral side and edges thereof.

When sheets of paper are to be inserted in or removed from the folder, the snap fasteners are opened by placing the thumb on the flexible plastic sheet while the folder is held in the hand, and pulling with the other hand the front sheet of the folder. The resilient, flexible plastic sheet thus retains the sheets of paper or other like material in place in the folder on the post portions of the snap fasteners. Because of the flexible nature of the resilient plastic sheet, the sheets of paper are loosely kept in position between the resilient, flexible plastic sheet and the back sheet of the folder, thereby retaining the sheets of paper on the post portions of the snap fasteners while the fasteners are in an open position.

The embodiments of the invention in which an exclusive property or privilege is claimed are defined as follows:

1. In a folder for the retension or protection of sheets of paper or similar material including:

a folder having two sides and a fold line between the two sides, at least two spaced post portions of snap fasteners near the fold line of the folder and attached to and projecting inwardly from one side of the folder and adapted to pass through holes in the sheets of paper, and at least two spaced cap portions of the snap fasteners adapted to cooperate with said post portions and removable to permit removal or insertion of sheets of paper from said folder, the improvement wherein sheet retaining means are provided integral with the folder to retain the sheets of paper loosely in position on the post portions when the cap portions are removed from the post portions, said retaining means comprising a retaining sheet of resilient, flexible plastic or similar material of a size slightly smaller than one side of said folder, said retaining sheet being attached on one edge to the folder at or about the fold line and having a hole in register with each post portion whereby said retaining sheet normally overlies the side of the folder having said post portions and acts to retain a sheet of paper placed over the post portions prior to fastening the cap portions and said retaining sheet holds said sheets of paper in position while the side of the folder having the cap portions is uncapped.

2. A folder according to claim 1 wherein said retaining sheet is made of a clear plastic which permits reading of information on the top sheet of paper through said retaining sheet.

3. A folder according to claim 1 further comprising at least one pocket means provided on either one of the inner surfaces of the folder.

4. A folder according to claim 2 further comprising at least one pocket means provided on either one of the inner surfaces of the folder.

5. In a bank passbook folder for the retention and protection of sheets of paper which comprises the bank customer's account records including:

a folder having two sides and a fold line between the two sides, a pair of spaced post portions of snap fasteners near the fold line of the folder and attached to and projecting inwardly from one side of the folder and adapted to pass through holes in the sheet of paper, and a pair of spaced cap portions of the snap fasteners adapted to cooperate with said post portions and removable to permit removal or insertion of sheets of paper from said folder, the improvement wherein sheet retaining means are provided integral with the folder to retain the sheets of paper loosely in position on the post portions when the cap portions are removed from the post portions, said retaining means comprising a retaining sheet of resilient, flexible clear plastic which permits reading of information on the top sheet of paper through said retaining sheet of a size slightly smaller than one side of said folder, said retaining sheet being attached on one edge to the folder at or about the fold line and having a hole in register with each post portion whereby said retaining sheet normally overlies the side of the folder having said post portions and acts to retain a sheet of paper placed over the post portions prior to fastening the cap portions and said retaining sheet holds said sheets of paper in position while the side of the folder having the cap portions is uncapped.

6. A folder according to claim 5 further comprising at least one pocket means provided on either one of the inner surfaces of the folder.

* * * * *